US005608632A

United States Patent [19]

White

[11] Patent Number: 5,608,632

[45] Date of Patent: Mar. 4, 1997

[54] SELF-CONTAINED SEQUENTIAL-THROTTLE-BODY-INJECTION ENGINE CONTROL SYSTEM

[76] Inventor: Robert M. White, P.O. Box 337, Arroyo Grande, Calif. 93421

[21] Appl. No.: 139,503

[22] Filed: Oct. 19, 1993

[51] Int. Cl.[6] ..... G06G 7/70; F02M 51/00

[52] U.S. Cl. ..... 364/431.051; 364/431.12; 364/431.04; 364/431.03; 123/480; 123/478; 123/417; 123/73 C; 123/472; 123/418; 123/415; 123/497

[58] Field of Search ..... 364/431.01–431.12; 123/478, 399, 415, 416, 494, 571, 672, 480, 417, 489, 491, 492, 575, 457, 54.4, 459, 580, 583, 308, 73 A, 299, 305, 73 C, 445, 472

[56] References Cited

U.S. PATENT DOCUMENTS

| | | | |
|---|---|---|---|
| 4,058,709 | 11/1977 | Long | 364/431.05 |
| 4,073,270 | 2/1978 | Endo | 364/431.05 |
| 4,149,496 | 4/1979 | Palma | 123/470 |
| 4,180,023 | 12/1979 | Kobayashi et al. | 123/478 |
| 4,284,053 | 8/1981 | Merrick | 123/497 |
| 4,290,394 | 9/1981 | Frank et al. | 123/73 A |
| 4,341,193 | 7/1982 | Bowler | 123/472 |
| 4,347,823 | 9/1982 | Kessler et al. | 123/472 |
| 4,408,582 | 10/1983 | Merrick | 123/415 |
| 4,446,833 | 5/1984 | Matsushita et al. | 123/435 |
| 4,473,051 | 9/1984 | Chorman | 123/476 |
| 4,492,913 | 1/1985 | Arnold et al. | 123/472 |
| 4,524,745 | 6/1985 | Tominari et al. | 123/478 |
| 4,538,573 | 9/1985 | Merrick | 123/418 |
| 4,546,746 | 10/1985 | Sato et al. | 123/478 |
| 4,805,571 | 2/1989 | Humphrey | 123/316 |
| 4,955,348 | 9/1990 | Buddle et al. | 123/478 |
| 4,964,381 | 10/1990 | Shiozaki et al. | 123/734 A |
| 5,088,464 | 2/1992 | Meaney | 123/478 |
| 5,091,858 | 2/1992 | Paielli | 364/431.12 |
| 5,174,263 | 12/1992 | Meaney | 123/478 |
| 5,271,477 | 12/1993 | Gekka et al. | 60/302 |
| 5,359,972 | 11/1994 | Isaka | 123/308 |
| 5,367,998 | 11/1994 | Shiohara | 123/457 |

*Primary Examiner*—Kevin J. Teska
*Assistant Examiner*—Jacques Louis-Jacques
*Attorney, Agent, or Firm*—Albert O. Cota

[57] ABSTRACT

An engine control system that is configured to be attached to the intake port or intake manifold of a reciprocating engine. The system can be designed to allow installation as original equipment or as a retrofit unit. In either case, the system provides the engine with a dual ignition and electronically controlled fuel-injection. The system includes a master control unit (MCU) that utilizes a firmware operated microprocessor. The MCU is connected to a plurality of sensors that sense critical system parameters that determine the engine settings. All system parameters are user-controlled by three system command switches that are located on a control display unit (CDU). The CDU is attached to the MCU by an electrical cable and is positioned on the vehicle to provide easy accessibility.

17 Claims, 8 Drawing Sheets

SELF-CONTAINED SEQUENTIAL-THROTTLE-BODY-INJECTION ENGINE CONTROL SYSTEM

TECHNICAL FIELD

The invention pertains to the general field of electronic control systems for reciprocating engines and more particularly to an electronic engine control system that employs a firmware controlled computer that operates a fuel injection system, a dual ignition and allows system performance parameters to be added, deleted or changed by the vehicle user to optimize engine performance.

BACKGROUND ART

Past methods for operating computer-controlled engines having fuel injection and dual-ignition systems has resulted in inflexible computerized controlled systems. These systems typically depend on programmed algorithms that control the engine parameters which provide improved operation under conditions anticipated by the computer program. To add, delete or change any of the engine parameters requires an external computer to input any user-desired customized changes. These engine control systems may be designed as original equipment or designed to replace conventional carburetor input engines. In either case, the system must be able to adjust the engine to various throttle demands, fuel-air mixtures, altitude, rpm, etc. To control these engine parameters, the system must receive and process various inputs from the engine. In addition to the dynamic requirements, there also remains the physical compatibility of the retrofit-design system to convert carburation based engines to electronic fuel injection system.

Presently there are two types of electronic fuel injection systems. These are throttle body injection and port injection.

Throttle body injection implies that the fuel injectors themselves are mounted in a throttle body, where the system functions much as a computer-controlled carburetor. This implementation has the drawback of not being able to meter fuel separately for each engine cylinder.

Port injection mounts the injectors near the intake valve of each cylinder, at the cylinder's intake port. Early systems fired the injectors in banks to simplify the controlling electronics however, this resulted in fuel puddling at the intake valve. Recently, the port style systems have been improved such that they time the injection pulse for each injector and eliminate the fuel puddling and provides better fuel atomization and throttle response. This type of port injection is also referred to as sequential port injection.

The engine control system of the instant invention has the injectors mounted in a throttle body therefore, it can be considered a throttle body injection system. However, since it injects fuel metered to the individual needs of each cylinder, it also has the advantages of a sequential port injection system. Therefore, it is referred to as sequential throttle body injection which can be used on multiple cylinder engines and allow a throttle body injection system to provide most of the performance benefits of a sequential port injection system, at a much lower installed cost.

Additionally, the present invention includes a user-friendly firmware program and an external input/output port. The program is accessed by a control display unit that is operated by only three push-button switches and the port allows an external input unit, such as a computer or modem, to be connected to further expand the selection and control of system parameters.

Because of the considerable increase in power and fuel efficiency provided by a user-programed, fuel injection engine, it is desirable to produce an engine control system that will overcome the problems and limitations of the prior-art systems. Therefore, it is important to anyone making such an investment and conversion that the system be designed to minimize mechanical problems and be both user friendly while maximizing user performance.

A search of the prior art did not disclose any patents that read directly on the claims of the instant invention, however the following U.S. patents were considered related:

| U.S. PAT. NO. | INVENTOR | ISSUED |
|---|---|---|
| 5,174,263 | Meaney | 29 December 1992 |
| 5,091,858 | Paielli | 25 February 1992 |
| 5,088,464 | Meaney | 18 February 1992 |
| 4,955,348 | Budde et al | 11 September 1990 |

The Meaney U.S. Pat. Nos. 5,174,263 and 5,088,464 disclose an engine management system specifically designed to manage the operation of a V-twin motorcycle engine. The system includes a throttle body and a throttle. The throttle body has an air intake manifold that mounts over the cylinder intake ports and the throttle which is operated by an operator, admits combustion air into the manifold. A pair of fuel injectors are mounted on the throttle body and respond to electronic injector control signals for injecting fuel into the air intake manifold. Fuel is delivered by a fuel pump which is regulated by a pressure regulator. An engine speed sensor supplies a signal that represents engine speed and a pressure sensor supplies a signal that represents the combustion air available in the manifold. The two signals are processed by an electronic controller in a look-up table that is addressed as a function of the speed and pressure signals. The injector control signals are then generated from data obtained in the look-up table.

The 5,091,858 Paielli patent discloses an electronically controlled engine fuel delivery system. The system includes a fuel injector and a plurality of sensors. The fuel injector is responsive to electronic control signals for delivering fuel to the engine cylinders and the sensors provide signals corresponding to engine operating conditions to a microprocessor based electronic control unit. The unit includes a memory that stores engine control parameters in several look-up tables. The tables are periodically addressed and thereafter supply control signals to operate the fuel injectors. The control unit includes circuitry for up-loading selected tables for the memory, monitoring engine operation as reflected by addressing of the parameters tables in real time and selectively initiating a programming mode of operation that continues uninterrupted.

The 4,955,348 Budde et al patent discloses a fuel injection conversion system fop V-twin motorcycles. The system includes an intake manifold having separate ducts that deliver a fuel and air mixture separately to each cylinder. A pair of fuel injectors mix the fuel from the injector with air drawn into the engine cylinders through the intake manifold. The individual pressurized fuel flow delivered to each injector is provided by a fuel distributor that is applied the pressurized fuel from the fuel source by a fuel pump.

The system also includes a fuel flow pressure regulator disposed in the fuel delivery system for controlling the pressure of the fuel flow delivered by the distributor to the injectors. To determine when the ignition system of the engine delivers an electronic pulse to fire the spark plugs, an electronic sensing means is included. The system also includes a status sensing means for measuring a combination of air and engine temperatures and the vacuum in the intake manifold. The combination of the electronic and status sensing means produce an electronic signal which operates the fuel injectors at the proper time and duration to deliver the proper amount of fuel to the cylinders of the engine by timed injection.

The Budde system as differs from the applicant's engine control system in that the Budde system:

1. is designed for motorcycle engines having two cylinders, an ignition system and a fuel source, The applicant's system is adaptable to any engine and includes its own ignition system.

2. requires and is secured to an intake manifold having separate ducts. The applicant's system does not require a special manifold it simply bolts to any manifold of directly to a cylinder head.

3. requires the use of a fuel distributor. The applicant's system does not require a fuel distributor instead, a separate fuel cap is used for each injector. The fuel cap delivers pressurized fuel to the injector as well as providing mechanical support for the injector.

4. requires a status sensing means for measuring a combination of air intake, engine temperature and vacuum in the intake manifold. The applicant's system does not monitor air intake, engine temperature of the manifold vacuum.

5. requires an ignition system. The applicant's system does not require that the engine have an ignition system.

For background purposes and as indicative of the art to which the invention is related, reference may be made to the remaining patents found in the search.

| U.S. PAT. NO. | INVENTOR | ISSUED |
|---|---|---|
| 4,805,571 | Humphrey | February 1985 |
| 4,538,573 | Merrick | September 1985 |
| 4,546,746 | Sato, et al | October 1985 |
| 4,524,745 | Tominari, et al | June 1985 |
| 4,492,913 | Arnold, et al | January 1985 |
| 4,473,051 | Chorman | September 1984 |
| 4,446,833 | Matsushita, et al | May 1984 |
| 4,408,582 | Merrick | October 1983 |
| 4,347,823 | Kessler, et al | September 1982 |
| 4,341,193 | Bowler | July 1982 |
| 4,290,394 | Frank, et al | September 1981 |
| 4,284,053 | Merrick | August 1981 |
| 4,180,023 | Kobayashi, et al | December 1979 |
| 4,149,496 | Palma | April 1979 |
| 4,073,270 | Endo | February 1978 |
| 4,058,709 | Long | November 1977 |

DISCLOSURE OF THE INVENTION

The engine control system is designed to be used on reciprocating engines either as original equipment or as a retrofit unit for carburetor based engines such as used on motorcycles. When the system is to be utilized as a retrofit unit, it is designed to convert the engine to one that operates with electronic-controlled fuel-injection and dual-ignition. In either design, the engine control system allows preselected system operating parameters to be monitored and user-adjusted to compensate for various road and environmental conditions. The engine control system operates preferably with an internal firmware program. However, the system also incorporates a serial input/output port into which may be connected an external input unit such as a computer or modem that allows additional engine parameters to be selected and controlled.

Modern electronic fuel injection consists essentially of a pressurized fuel source, a solenoid valve and an electronic controller. The amount of fuel delivered to the engine is determined by the amount of time that the valve is open. The electronic controller determines the engine's fuel needs and energizes the solenoid valve to open or to close accordingly. The solenoid valve is supplied with fuel at a constant pressure by means of a fuel pump and a bypass pressure regulator. The presence of a constant flow of fuel provides cooling for the fuel pump and prevents vaporlock.

The engine control system of the present invention has two injectors to optimize fuel flow control and both injectors are central to the two cylinders. At engine idle, only one injector is typically activated, at higher speeds both injectors are activated. Injecting fuel only when the intake valve is open eliminates fuel puddling in the intake tract, provides crisp response and good fuel atomization. The two fuel injectors are located past the throttle plate and do not impede the air flow and in this position they function much like a port injection system. Furthermore, the symmetrically opposed injectors provide increased fuel atomization due to impingement of the two angularly directed fuel streams. The present invention also utilizes two separate transistorized ignition capabilities. While they each drive their own spark coil, they provide single fire capability.

The engine control system is particularly adaptable for attachment to a Harley Davidson motorcycle engine and allows duplication of the standard Harley-Davidson ignition system. The electronic controller hereinafter referred to as a master control unit (MCU) consists of a digital computer, analog amplifiers (for reading sensors), a power output section for driving the input and output ports and serves as the input and output for the control display unit (CDU). The CDU in the preferred embodiment, consists of an alphanumeric liquid crystal display and three pushbutton switches that allow various system parameters to be selected and viewed on the digital display. The display is backlighted to facilitate night visibility, is temperature compensated, and the switches are housed in a splash-proof enclosure to provide protection against rain and road splash. The enclosure also includes a drain hole to allow any condensation of moisture to drain.

One of the inventive features of the current engine control system is that it is contained within a single structure, with the exception of the CDU which is not required for system operation. This structure is then attached to the engine intake manifold or the intake port of the engine. Having a single structure is advantages when it comes to retrofitting fuel injection to a previously carbureted engine. It could also be an advantage to the OEM in reducing vehicle assembly time and reducing system interconnections.

SYSTEM ADJUSTMENTS

The system's operational condition may be controlled and displayed by the control display unit (CDU) or from an external computer connected to an RS-232 computer serial port located on the MCU. The three pushbutton switches on the CDU are used as follows: pressing the top or bottom pushbuttons steps through selectable choices and pressing the middle pushbutton activates the display choice selected.

For example to provide a proper fuel mixture control requires two steps:

1. Adjust the RPM vs. fuel flow fuel curve to the desired engine performance.

2. Adjust the overall mixture in response to changing atmospheric conditions.

Step 1 is accomplished by using the ENRICH/LEAN BOTH CYL commands from the Mixture Adjust Submenu. This command allows the active mixture curve to to be adjusted to the requirements of the engine and it only needs to be changed if any engine hardware such as the camshaft or pipes are changed. Such an adjustment entails tuning for best power and is easily accomplished on a dynamometer or on a test track.

Steps 2 is accomplished by using the ENRICH/LEAN MIXTURE OVERALL commands from the Mixture Adjust Submenu. This adjustment is normally performed on a daily basis to compensate for air density changes resulting from daily, or hourly temperature changes. Relocation to a new altitude and barometer changes can also be considered.

The MCU memory contains 64 numerical values of solenoid pulse width each corresponding to the logic and values of a discrete throttle position vs. an rpm value range. To the user, this represents a table as shown below which has rpm plotted on one axis and throttle position on the other axis where the intersections of memory values specify injector pulse time increments.

| RPM | RPM INDEX | | | | | | | | |
|---|---|---|---|---|---|---|---|---|---|
| 7000 | 7 | 175 | 365 | 610 | 700 | 790 | 800 | 820 | 830 |
| 6000 | 6 | 180 | 375 | 630 | 710 | 815 | 850 | 895 | 910 |
| 5000 | 5 | 200 | 400 | 640 | 700 | 845 | 875 | 950 | 959 |
| 4000 | 4 | 190 | 365 | 650 | 701 | 850 | 878 | 977 | 1005 |
| 3000 | 3 | 220 | 475 | 710 | 854 | 922 | 889 | 995 | 1022 |
| 2000 | 2 | 223 | 576 | 770 | 870 | 990 | 1000 | 1090 | 1100 |
| 1000 | 1 | 242 | 716 | 790 | 890 | 1000 | 1150 | 1160 | 1170 |
| 250 | 0 | 245 | 740 | 800 | 900 | 1020 | 1160 | 1170 | 1180 |
| | | 0 | 1 | 2 | 3 | 4 | 5 | 6 | 7 |

THROTTLE POSITION INDEX
(← CLOSED OPEN →)

ENGINE FUEL MAP

For example, if the rpm index is 2 (2000 RPM) and throttle index is 3 (about one half throttle) are activated, the fuel injectors should pass a fuel pulse that lasts 870 time units. A system algorithm counts time in units of eight-millionths of a second, therefore, 870 time units equals an injector pulse width of 8×870=6960 microseconds. Where settings of the throttle of the rpm are other than that of the 64 discrete values, the processor algorithm interpolates and calculates a corrected corresponding injector time value.

Spark timing is another controllable parameter and is accomplished similarly to the previous fuel mixture control settings. In this case, the numerical values are designed to control the required spark timing. This allows fop spark timing that varies with engine load and provides an extremely adjustable spark timing "curve". Typically, the user will advance the spark until the engine pings, then retard it until the pinging stops. With the MCU, it is possible to adjust the pinging out at only the points where the engine wants to ping while leaving the rest of the timing curve with maximum advance fop maximum performance.

In view of the preceding disclosure, a number of invention objectives may be foreseen. Thus, the present invention includes, but is not limited to the following number of desired physical and control objects of the invention:

Mechanical features

Bolts directly to any manifold of engine head within its design parameters.

Adaptable to any engine with only minor firmware modifications.

Includes a dual ignition system.

Includes dual fuel injectors.

System packaged in one compact unit with the exception of the two spark coils and the control display unit.

Control Display Unit Features handlebar mounting to provide convenient access and visibility, Adjust mixture over entire engine operating range.

Adjust mixture separately for each cylinder if connected to a multiple cylinder engine.

Adjust spark timing, including adjustment for separate coils.

Adjust for different flow rates.

Adjust injector pulse timing.

Adjust for altitude and other parametric pressure changes.

Adjust for detonation prone fuel.

Adjust engine prime and start-up enrichment.

Enable and adjust cruise lean-out feature.

Enable and adjust acceleration enrichment.

Set engine timing.

Calibrate throttle position sensor.

Provide read-out instructions for making the above adjustments.

Changes and control made by only three pushbutton switches.

Display engine operating parameters such as: RPM, fuel consumption rate, vehicle speed, miles per gallon, temperatures of four sensors, throttle body temperature, engine acceleration, battery voltage, necessary adjustment procedure feedback, provision fop added and undefined sensors, diagnostics and self-test.

These and other objects and advantages of the present invent ion will become apparent from the subsequent detailed description of the preferred embodiment and the appended claims taken in conjunction with the accompanying drawings.

BRIEF DESCRIPTION OF THE DRAWINGS

FIG. 6 is a block diagram of the control display unit.

BEST MODE FOR CARRYING OUT THE INVENTION

Figure 1:
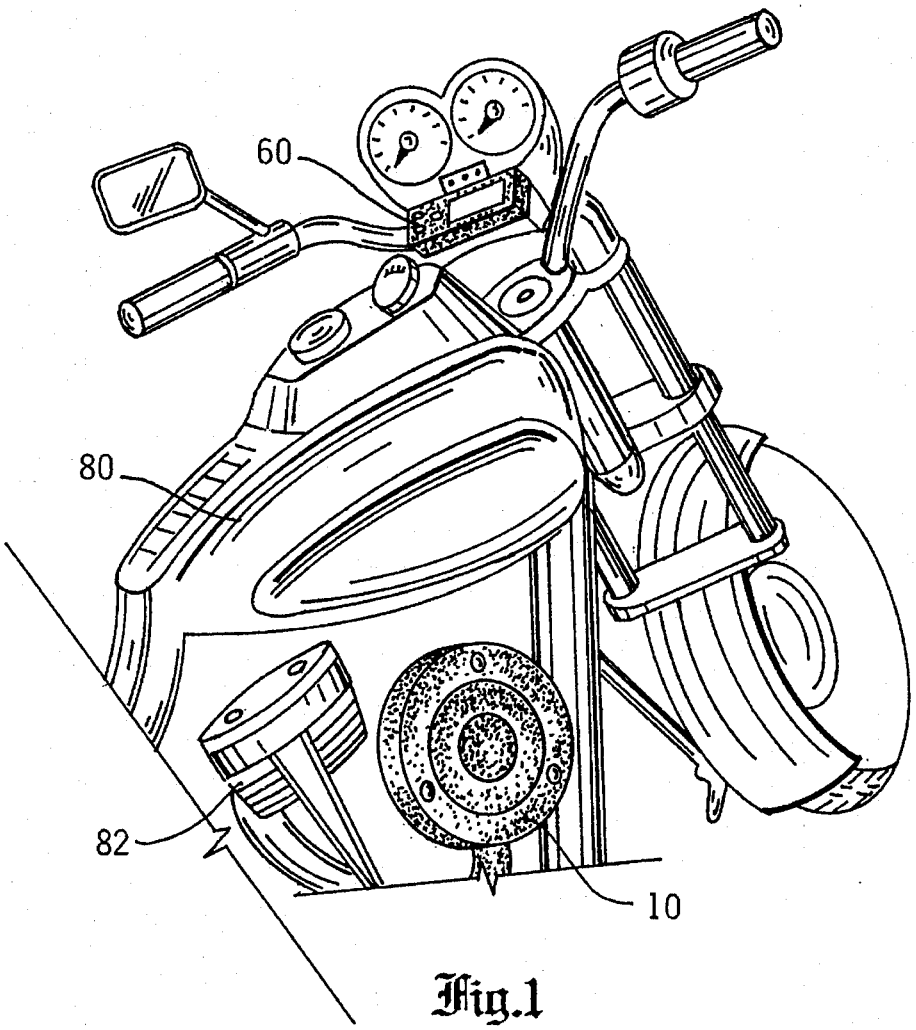
FIG. 1 is a partial side view of a motorcycle with the engine control system installed.

The best mode for carrying out the electronic engine control system 10 is presented in terms of a preferred embodiment that is particularly adaptable for controlling smaller reciprocating engines such as used on motorcycles. The preferred embodiment as shown in FIGS. 1–13 is comprised of eighteen major elements, a backing plate 12, a throttle body 14, a first fuel injector 16, a second fuel injector 18, a first fuel cap 20, a second fuel cap 22, a fuel pump 28, a fuel pressure regulator 30, an air filter 34, a cover plate 36, a master control unit (MCU) 40, a firmware 42, a plurality of sensors 44, 46, 48, a first spark coil 50, a second spark coil 52, a cover 54 and a control display unit (CDU) 60. The inventive elements function in combination with a vehicle 80 that operates with a vehicle engine 82 having an intake manifold 84, a fuel source 86, a fuel return sink 88 and a vehicle battery 90.

Figure 2:
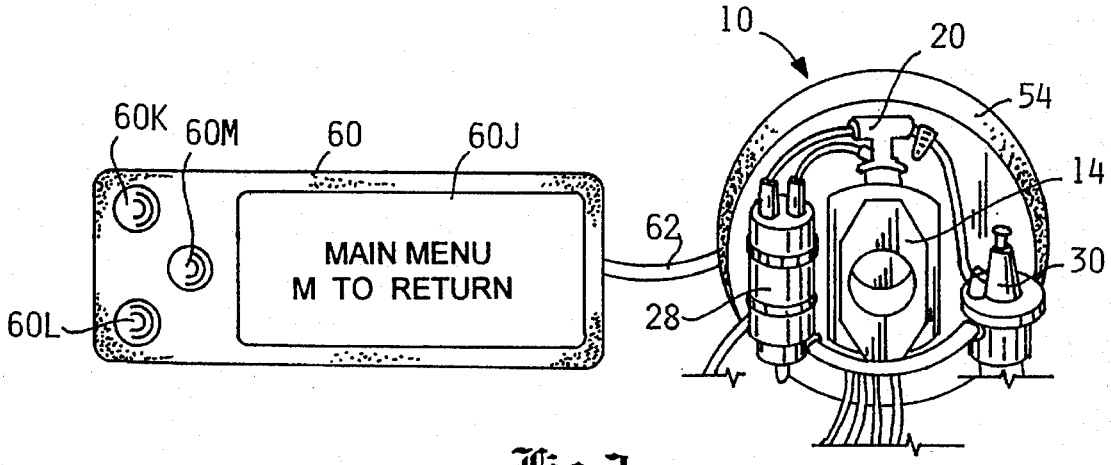
FIG. 2 is a perspective view of the engine control system as viewed from the back with an out-of-scale plan view of the control display unit.

The electronic engine control system 10 is designed to be installed as original equipment or as a retrofit unit that replaces a carburetor. In either case, the system is contained within a single structure that is attached directly to the intake port or intake manifold 84 of the engine 82. A retrofitted system 10 is shown attached to a motorcycle engine in FIG. 1 and in FIG. 2 is shown a perspective view of the system 10 as viewed from the back side and attached to an enlarged plan view of the control display unit 60 described infra.

Figure 3:
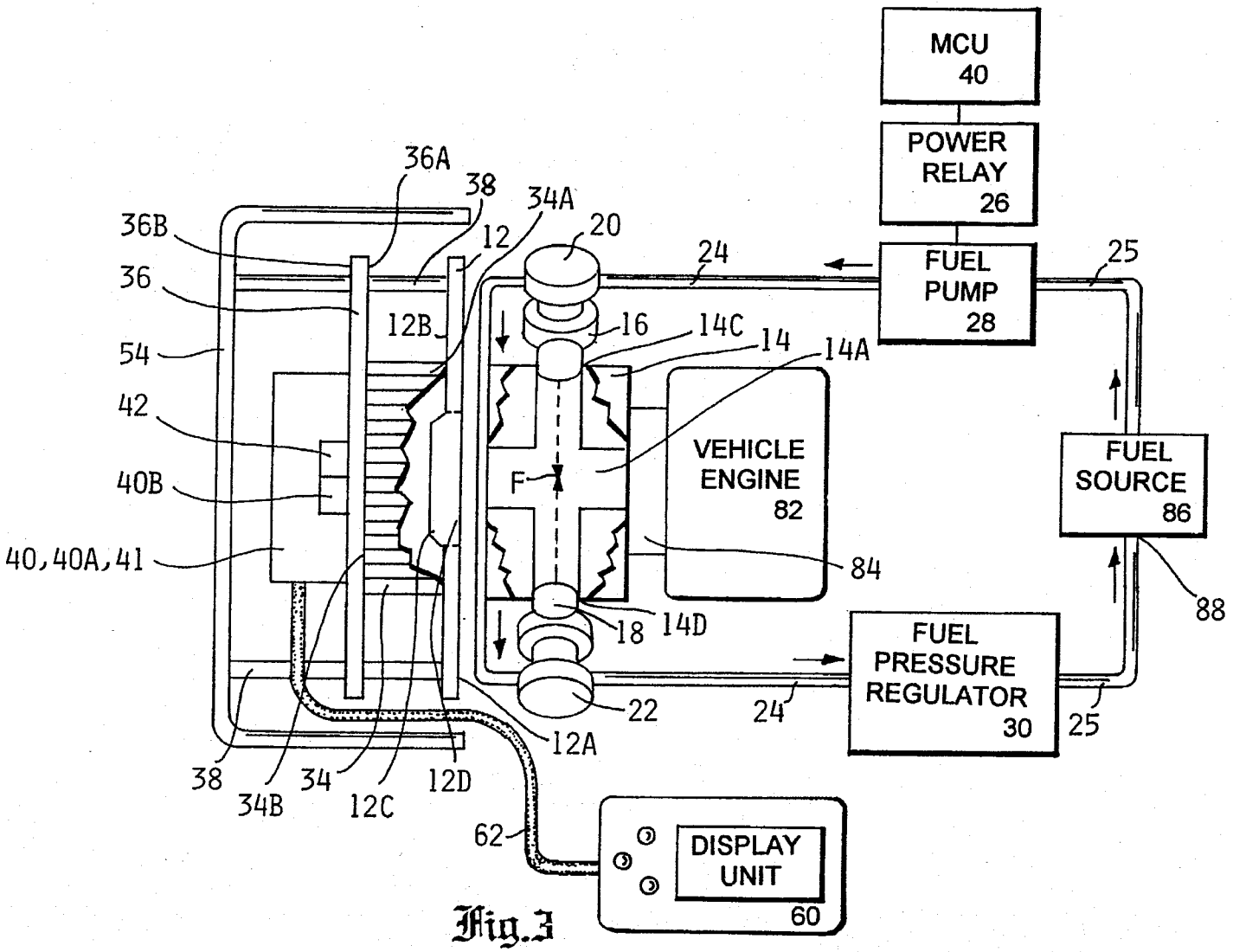
FIG. 3 is a side-block diagram showing the major elements of the engine control system.

The backing plate 12 as shown in FIG. 3, functions as a primary attachment structure for the system 10. The plate is preferably in a circular shape and has an inward side 12A, an outward side 12B and an integral and centered laminer air flow structure 12C having a bore 12D therethrough. To the inward side 12A of the backing plate 12 over the bore 12D is attached the throttle body 14.

Figure 4:
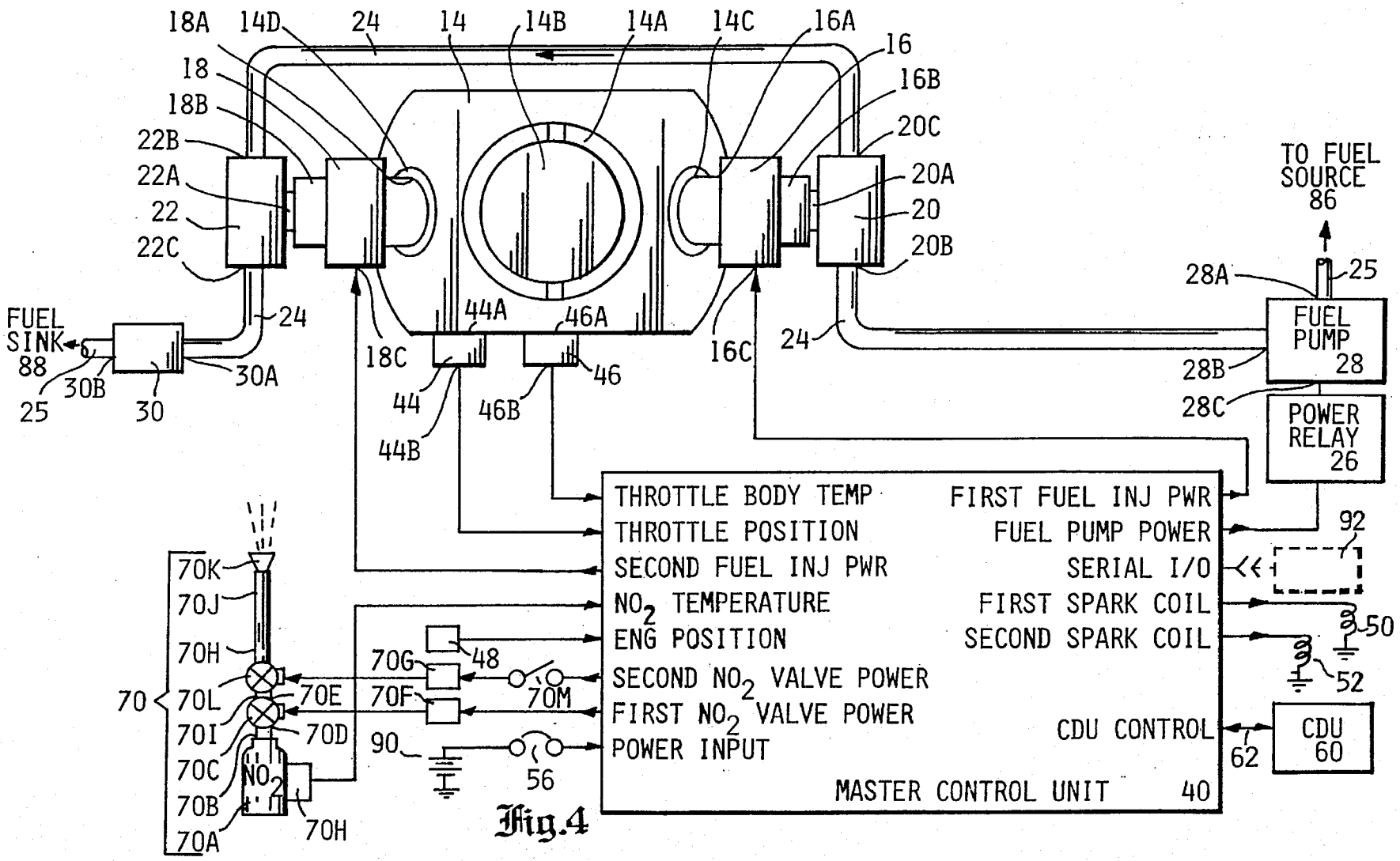
FIG. 4 is a schematic/block diagram of the engine control system which includes the input and output signals controlled by the master control unit.

The throttle body as shown in FIGS. 3 and 4 is preferably a casted or machined unit made of a metal such as aluminum. In the center of the throttle body 14 is located a throat 14A therethrough that further includes within the throat, a throttle plate 14B that moves about a center shaft. On one side of the throttle body as viewed from the top as best shown in FIG. 4, is a first fuel injection port 14C that is angularly displaced inwardly into the throat as measured from a frontal horizontal plane. In alignment with the first fuel injection port 14C and on the other side of the throttle body 14 is likewise located a second fuel injection port 14D. This second port is also angularly displaced inwardly into the throat as measured from the frontal horizontal plane.

As also shown in FIGS. 3 and 4, is the first fuel injector 16 and the second fuel injector 18. The injector 16 has an output port 16A, an input port 16B and a power input 16C. The output port 16A is attached to the first fuel injection port 14C on the throttle body 14. Likewise, the injector 18, has an output port 18A, an input port 18B and a power input 18C. The output port 18A is attached to the second fuel injection port 14D on the throttle body 14, when the first and second fuel injectors 16, 18 are attached, they do not intrude into the throttle body air stream and they are angularly displaced to allow the fuel stream, emitted from each injector, to impinge at a common point (F), located on the extended centerline of the throat 14A of the throttle body 14 as shown by the dotted lines and interfacing arrows in FIG. 3. The impinging fuel causes an extra degree of fuel atomization which is beneficial to the engine's operation and results in cleaner emissions and better mileage.

The first and second fuel injectors 16, 18 function in combination with a first fuel delivering means which preferably consists of the first fuel cap 20 and a second fuel delivery system which preferably consists of the second fuel cap 22. The fuel caps provide the fuel passage into the system 10. The first fuel cap has a fuel injector attachment port 20A, an input port 20B and an output port 20C. The fuel injector attachment port 20A is sized to be attached to the input port 168 oil the first fuel injector 16. Likewise, the second fuel cap has an input port 22B, an output port 22C and a fuel injector attachment port 22A that is attached to the input port 18B of the second fuel injector 18. As shown in FIG. 4, the output port 20C of the first fuel cap 20 is connected to the input port 228 of the second fuel cap 22 by means of a high-pressure hose 24.

The fuel that flows through the fuel caps and injectors is provided by at least one fuel pump 28 as shown in FIGS. 3 and 4. The fuel pump includes an input port 28A, all output port 28B and a power input 28C. The input port 28A is connected to the fuel source 86 by a low-pressure hose 25 and the output port 28B is connected by means of a high-pressure hose 24 to the input port 20B on the first fuel cap 20.

The fuel flow is regulated by at least one fuel pressure regulator 30. The regulator has an input port 30A that is connected by means of a high-pressure hose 24 to the output port 22C Of the second fuel cap 22. The regulator 30 also includes an output port that is connected by means of a low-pressure hose 25 to a fuel source return sink 88 as shown in FIG. 4.

As shown in FIG. 3, an air filter 34 having an inward side 34A and an outward side 34B is used to help prevent debris from entering the throat 14A of the throttle body 14. The air filter is removably placed over the laminar air flow structure 12C on the backing plate 12 with the filters inward side 34A resting against the outward side 12B of the backing plate 12. The filter is held in place by means of a cover plate 36 that has an inward side 36A and an outward side 36B. The inward side 36A is placed over the outward side 34B of the air filter 34 and the cover is attached by means of a plurality of standoffs 38 to the outward side 12B of the backing plate 12.

The final structural element that comprises the system 10 is the cover 54. This cover extends around the area extending from the front of the master control unit 40 to the end of the backing plate 12. The cover is attached by means of a plurality of standoffs that are attached to the outward surface of the cover plate 36.

The preferred embodiment of the system 10 is as described above. However, the throttle body 14 may be further comprised of an additional plurality of fuel injection ports symmetrically located, in pairs, around the periphery of the throttle body. Into each of the fuel injection ports 14C is attached a fuel injector that does not intrude into the air stream as is common practice in conventional throttle body type injectors. Each of the injectors emits a fuel stream that impinges at the common point (F). The turn-on of the fuel injectors is systematically controlled by the master control unit 40 to allow the engine horsepower to be increased while still allowing the idle mixture to be closely controlled.

To assure that the system 10 is being operated at an optimum level, a plurality of analog and digital sensors are attached at critical locations on the system. The sensors, depending on their design and type, may be surface attached by an adhesive, or in some designs, it may be necessary to bore a hole into the attachment structure and insert the sensor therein. The system 10 includes as shown in FIG. 4, at least a throttle position sensor 44, a throttle body sensor 46 and an engine position sensor 48.

The throttle position sensor 44 has an input 44A and an output 44B. The input is connected to the shaft of the throttle plate 14B where the sensor senses the position of the throttle plate. The output 44B is connected to a throttle position input located on the master control unit 40.

The throttle body temperature sensor 44 has an input 46A and an output 46B. The input is connected to a side of the throttle body 14, where the sensor senses the temperature of the throttle body. The output 46B is connected to a throttle body temperature input located on the master control unit 40.

The engine position sensor 48 has an input 48A and an output 48B. The input may be connected to the engine points, the camshaft or other engine rotating element from where the sensor 48 senses the timing pulse of the engine. The output 48B is connected to an engine position input on the master control unit 40. Additionally, with the addition of pyrometer probes (not shown), the system can be adjusted to display the exhaust gas temperatures and the head temperature of the cylinders.

One of the inherent features of the system 10 is the ability of the system to provide either a single or dual spark energy to the engine 82. This arrangement allows the system 10 to control the spark of an engine having one to four cylinders. To accomplish this feature, at least one spark coil and preferably two spark coils: a first spark coil 50 and a second spark coil 52 are attached to the vehicle engine 82 or chassis. The two spark coils are arranged either:

1. in parallel with a common connection to a first spark coil output on the master control unit 40, or 2. the first spark coil 50 is connected to the first spark coil output signal on the master control unit 40 and the second spark coil 52 is connected to a second spark coil output signal on the master control unit 40. This second arrangement allows either the dual of single spark energy to be provided to the engine 82 as dictated by the master control unit 40.

The engine control system 10 is controlled and operated by the electronic master control unit (MCU) 40 and a control display unit (CDU) 60 that provides command and system status data.

The master control unit 40 is configured on a printed circuit board 41 that is attached by an attachment means to the outward side 36B of the cover plate 36 as shown in FIG. 3. The MCU has electronic circuit means that functions in combination with preferably a Motorola 68HC11 microprocessor 40D that operates with a firmware 42 to control the operation of the system 10.

Some of the system operations that are controlled by the master control unit include:

maintaining a short time history of throttle position data. From this data are developed statistical parameters which are then used to determine the engine's operating state. The prior art engine control system typically employ a multiplicity of sensors to determine the engine's operating state, that is, whether the engine is accelerating, cruising or decelerating. The inventive throttle position method of acquiring the engine's operating state is considerably simpler in that the multiplicity of sensors is not required.

determining which engine cylinder is receiving the air stream passing through the throttle body; and then metering the fuel from the fuel injectors into the air stream in accordance with the requirements of the engine cylinder.

controlling the operation of a fuel mixture map. In current engine control systems, the mixture map, and in some cases a spark timing map, must be accessed point-by-point to make changes. In the system 10, it is not necessary to determine which point to adjust and to access that point specifically, instead, the system 10 in combination with the MCU 40 allows access automatically to the closest map point to where the engine is currently operating. This allows an intuitive approach to adjusting the engine, in that it is no longer necessary to use a computer to access the map. Instead, the user just makes the adjustment i.e., richer leaner, advanced or retarded. The engine then responds by adjusting the map to the point where the engine is currently operating. This technique makes adjusting the system something that anyone can perform, since it removes a level of abstraction that is difficult to follow. It also provides a user or mechanic with immediate feedback to the adjustment, in that the results of the adjustment can be readily determined.

The simplicity of the fuel mixture map is further enhanced by noting that other engine control systems use maps with a resolution to provide smooth, continuous control of the engine 82. The system 10 utilizes a map with sparse data points. Between at least two of these points, a linear interpolation in two dimensions is performed. This interpolation smooths the data between the two sparse data points to increase the resolution to better control the performance of the engine 82. This method has the advantage of requiring less computer memory to store the maps, as well as making the adjustment process easier due to their being fewer map points to adjust.

In the preferred embodiment, the MCU as shown In FIG. 4 includes the following analog and digital system inputs and outputs:

1. A throttle position input that receives a signal from the throttle position sensor 44.

2. A throttle body temperature input that receives a signal from the throttle body temperature sensor 46.

3. An engine position input that receives a signal from the engine position sensor 48.

4. A first fuel injector power output that controls the fuel injection on-time and is applied to the power input of said first fuel injector 16.

5. A second fuel injector power output that controls the fuel injection on-time and is applied to the power input of the second fuel injector 18.

6. A fuel pump power output that energizes a power relay 26 that allows power to be applied to the power input 28C of the fuel pump 28.

7. A first spark coil output that is connected to the first spark coil 50.

8. A second spark coil output that is connected to the second spark coil 52.

9. A serial input/output port that allows an external input unit 92, such as a lap-top computer or modem, to be connected from where system parameters can be added, deleted or changed by a vehicle user.

10. A CDU control signal that is applied to the control display unit via the electrical cable 62, and 11. A power input that is connected to the vehicle battery 90 via a circuit breaker 56.

Figure 5:
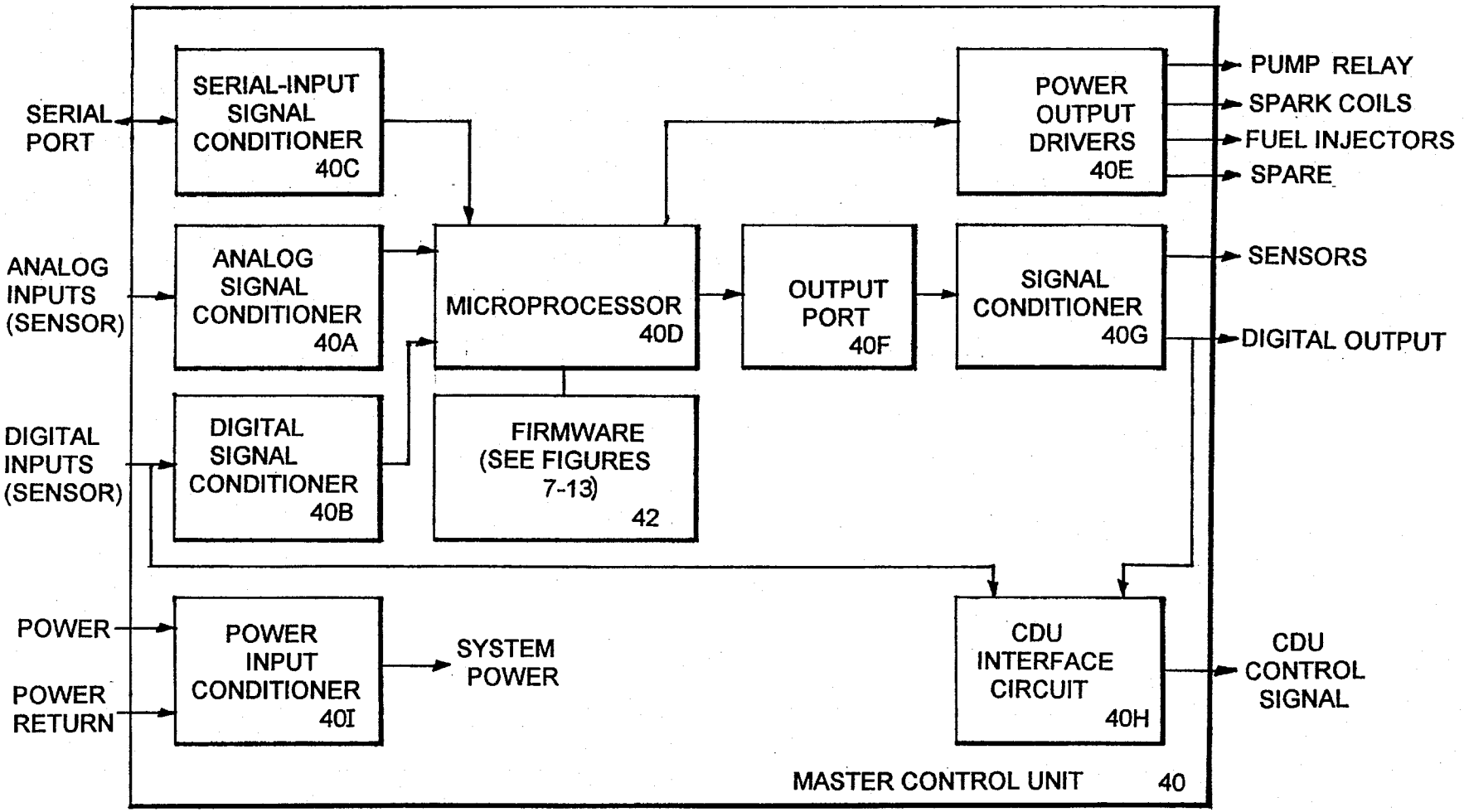
FIG. 5 is a block diagram of the master control unit.
Figure 5:
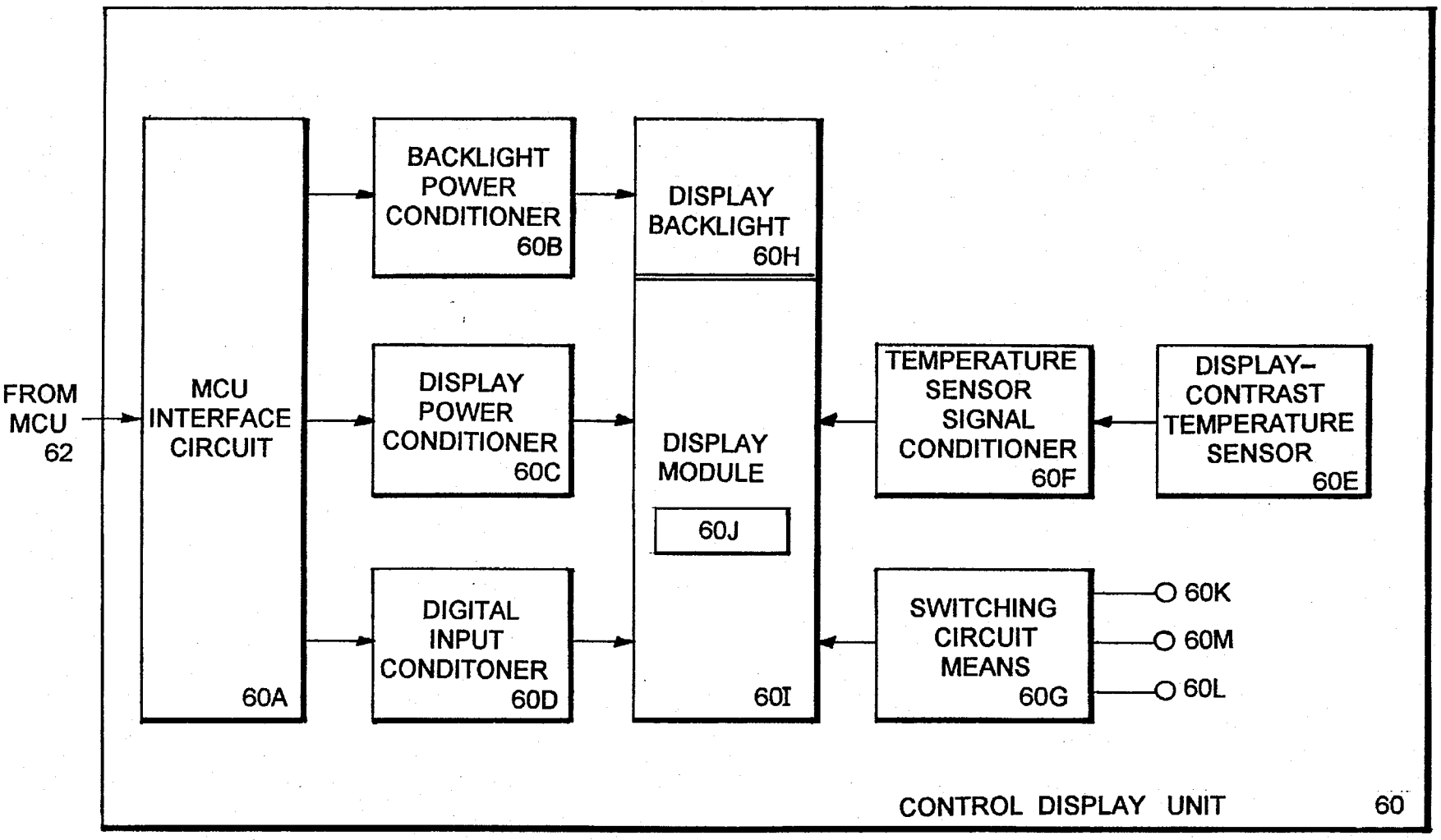
Figure 8:
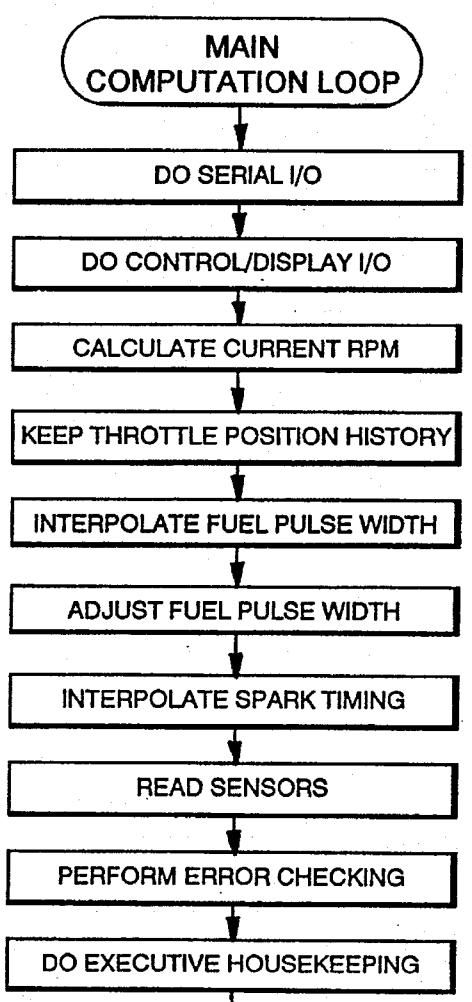
FIGS. 7–13 are the logic flow diagrams of the firmware that operates the master control unit.
Figure 7:
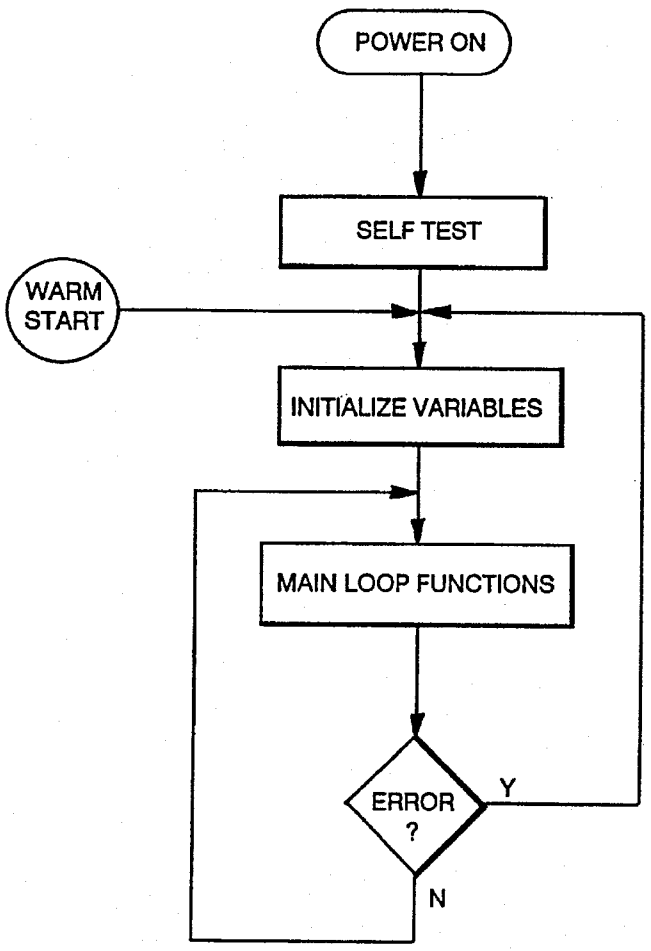
Figure 10:
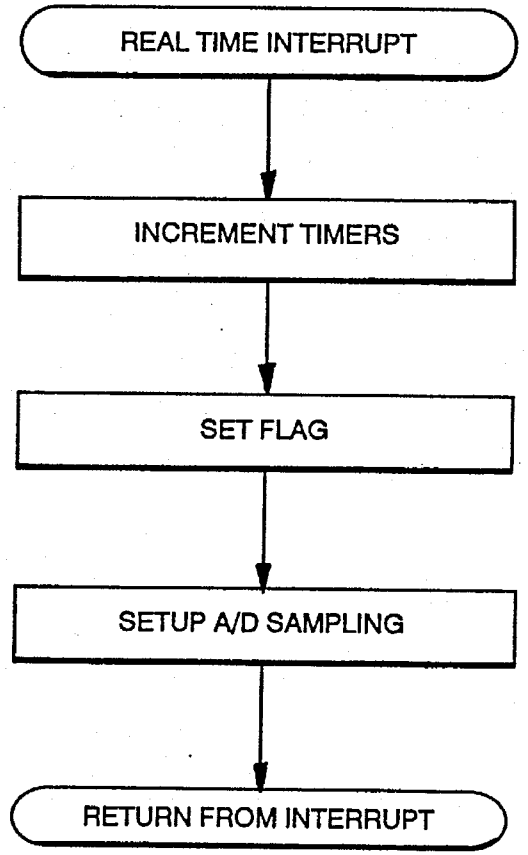
Figure 9:
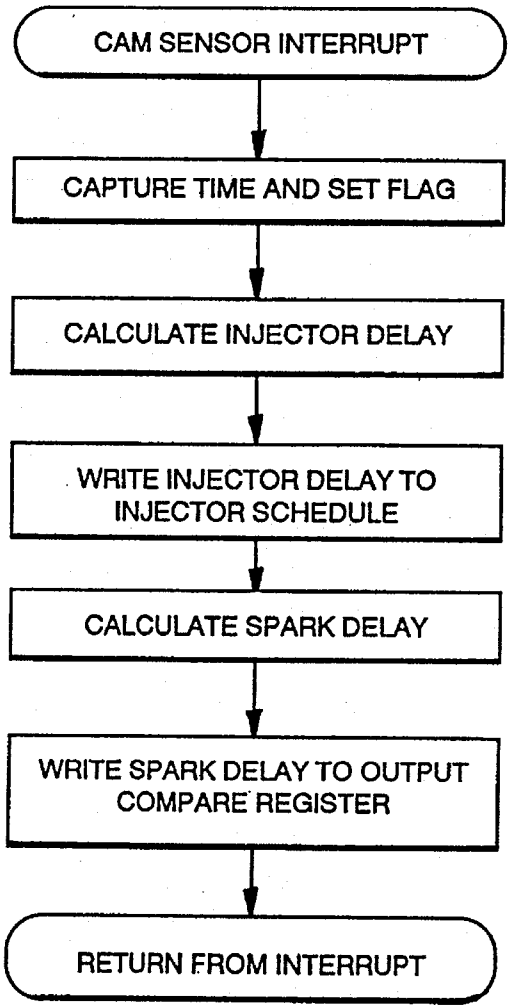
Figure 11:
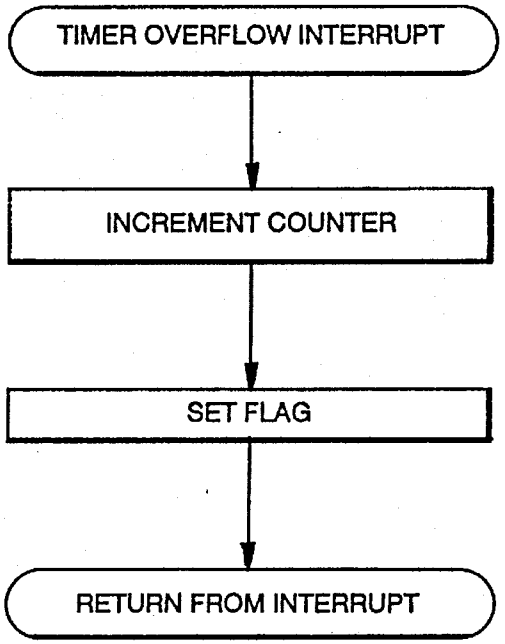
Figure 12:
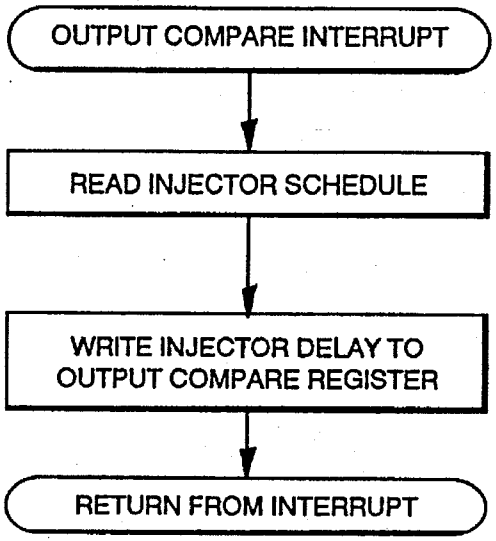
Figure 13:
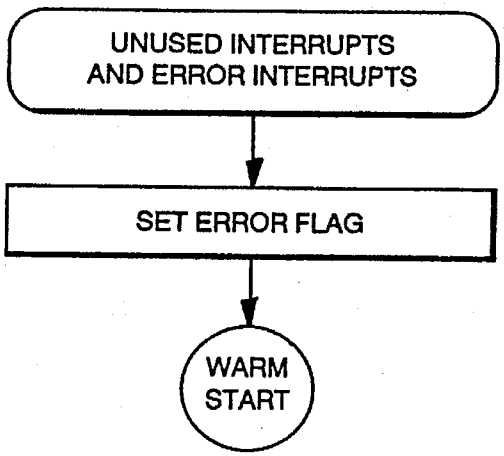

The electronic circuit means of the master control unit 40 consists of the following circuits as shown in the block diagram of FIG. 5:

1. An analog signal conditioner 40A having electronic circuit means for receiving and conditioning the inputs from the sensors having analog outputs.

2. A digital signal conditioner 40B having electronic circuit means for receiving and conditioning the input signals from the sensors having digital outputs.

3. A serial-input signal conditioner 40C having electronic circuit means for receiving an external signal from the external input unit 92, 4. A microprocessor 40D that operates with the firmware 42 and having electronic circuit means for processing the conditioned signals from the analog signal conditioners 40A, the digital signal conditioners 40B add the serial input signal conditioner 40C. The microprocessor 40D drives a plurality of internal power output drivers 40E have that control the operation of the power relay 26, first spark coil 50, second spark coil 52, first fuel injector 16 and the second fuel injector 18. The microprocessor also provides a signal that operates through an output port 40F to drive a signal conditioner 40G that produces a digital output signal, 5. A CDU interface circuit 40H having electronic circuit means for receiving internal input and output signals and having an output that is connected by means of the electrical cable 62 to the control display unit 60, and 6. A power input conditioner 40I having electronic circuit means for receiving the input power from the vehicle battery 90 via a circuit breaker 56 and producing a power signal that powers the electronic circuits of the master control unit 40.

The firmware 42 operates in a timed, selectable sequence and is comprised of the following logic functions as described in FIGS. 7–13:

1. power on,
2. self test,
3. main computation loop,
4. CAM sensor interrupt and return from interrupt,
5. real-time interrupt and return from interrupt,
6. timer overflow interrupt and return from interrupt,
7. output compare interrupt and return from interrupt, and
8. error interrupts.

The control display unit 60 as shown in a plan view in FIG. 2 and as a block diagram in FIG. 6, is designed to be mounted in an accessible area to allow a user to depress the three system command push-button switches 60I, 60J and 60K. When used with a motorcycle, the CDU 60 is preferably mounted on the handlebars from where a user can easily depress the switches and view the switch response on the digital display which preferably consists of a liquid crystal display. The electronic circuit means for the CDU 60 consists of the following circuits as shown in FIG. 6:

1. An MCU interface circuit 60A having circuit means for receiving and processing the signals received from the master control unit 40.

2. A backlight power conditioner 60B having electronic circuit means for receiving and conditioning a backlight power signal provided by the master control unit 40 via the MCU interface circuit 60.

3. A display power conditioner 60C having electronic circuit means for receiving and conditioning a display power signal provided by the master control unit 40 via the MCU interface circuit 60.

4. A digital input conditioner 60D having electronic circuit means for receiving and conditioning digital control and sensor signals provided by the master control unit 40 via the MCU interface circuit 60.

5. A display-contrast temperature sensor 60E that produces a temperature control signal, 6. A temperature sensor signal conditioner 60F having electronic circuit means for receiving and processing the temperature control signal from the display-contrast temperature sensor 60E and producing a display control signal applied to the display module 60I. The application of the display control signal allows the display contrast to remain constant under varying temperatures.

7. A switching circuit means 60G that produces a switch control signal that corresponds to the closing of either the first system command switch 60K, the second system command switch 60L or the third system command switch 60M. The three switches as shown in FIG. 2 are located on the front panel of the display module 60 and are operated manually by a vehicle user. Pressing the first and second switches 60K, 60L allows the user to step through choices without activating any of the choices. When the third switch 60M is pressed, the choice as viewed on a digital display 60J located on the front panel of the display module, is selected and processed. The display module 60I has electronic circuit means for receiving and processing the switch control signal, the conditioned display power signal from the display power conditioner 60C, and the digital control sensor signals from the digital input conditioner 60D, and 8. A display backlight 60H that is activated upon the application of the backlight power signal from the backlight power conditioner 60B.

The engine control system may also be designed to include a nitrous oxide injection assembly 70 as shown in FIG. 4, that allows an increase in the available oxygen in the combustion chamber of the engine 82. This oxygen increase allows burning more fuel which results in higher engine horsepower.

The assembly 70 consists of a nitrous oxide source 70A that has an output port 70B. To the output port 70B is connected the input port 70D of an electrically operated first shut-off valve 70C which also includes a an output port 70E. The first shut-off valve 70K is connected electrically to a first relay 70F. When this first relay is energized by a first $NO_2$ valve power signal, that is applied and controlled by the master control unit 40, the first valve opens. The output port 70E of the first valve 70C is connected to an input port 70I on a fluid hose 70H that has an orifice 70K connected to its output port 70J by an attachment means. When the first shut-off valve is opened, the quantity of nitrous oxide is sprayed from the orifice 70K into the intake manifold 84 of the engine 82. As also shown in FIG. 4, a nitrous oxide sensor 70N can also be connected to an $NO_2$ temperature input on the master control unit 40.

The primary nitrous oxide injection assembly 70 can be designed to include a safety assembly that further safeguards the operation of the assembly 70. The safety assembly which is also shown in FIG. 4, includes a second shut-off valve 70L that is connected in series with the first shut-off valve 70C. This second valve is connected to a second relay 70G that is controlled by a single-pole single-throw switch 70M. The switch has a first side that is connected to the second $NO_2$ valve signal controlled by the master control unit and a second side that is connected to the second shut-off valve 70G. When the MCU 40 outputs the second $NO_2$ valve, power signal and the switch 70M is manually closed, the second relay 70G is energized to a allow power to be applied that opens the second shut-off valve 70L.

While the invention has been described in complete detail and pictorially shown in the accompanying drawings, it is not to be limited to such details, since many changes and modifications may be in the invention without departing from the spirit and the scope thereof, For example, the primary purpose is to supply user controlled fuel injection to motorcycle engines. Hence, it is described to cover any and all modifications add forms which may come within the language and scope of the appended claims.

I claim:

1. A self-contained sequential-throttle-body-injection engine control system comprising:

A. a sequential throttle body fuel injection subsystem comprising:

a) a throttle body having an inward side and an outward side, where the inward side is attached to the intake manifold of the engine, and the outward side is attached to an inward side of a backing plate also having an outward side that is attached to an inward side of a cover plate further having an outward side that via a plurality of standoffs, attaches to a cover, said throttle body further comprising:

(1) a throat therethrough, (2) a first fuel injection port that is angularly displaced inwardly from the periphery of said throttle body into the throttle body into the throat as measured from a frontal horizontal plane, and (3) a second fuel injection port that is also angularly displaced inwardly from the periphery of said throttle body into the throat as measured from the frontal horizontal plane, b) a first fuel injector having an output port and an input port where the output port is attached to the first fuel injection port on said throttle body, c) a second fuel injector having an output port and an input port where the output port is attached to the second fuel injection port on said throttle body, where said first and second fuel injectors when attached, do not intrude into the throttle body air stream and are angularly displaced to allow the fuel stream emitted from each said injector to impinge at a common point (F), located on the extended centerline of the throat of said throttle body, d) a first fuel cap having a fuel injector attachment port, an input port and an output port, where the fuel injector attachment port is attached to the input port on said first fuel injector, e) a second fuel cap having a fuel injector attachment port, an input port and an output port, where the fuel injector attachment port is attached to the input port on said second fuel injector, f) means for connecting the output port of said first fuel cap to the input port of said second fuel cap, B. at least one fuel pump having an input port, an output port and a power input, where the input port is connected to a fuel source by means of a low pressure hose and the output port is connected by means of a high pressure hose to the input port on said first fuel cap, C. at least one fuel pressure regulator having an input port connected to the output port of said second fuel cap and an output port connected to a fuel source return sink, D. a plurality of analog or digital sensors attached by an attachment means at critical locations of said subsystem, where each said sensor produces an output signal corresponding to a system measured parameter, E. a spark coil attached to the vehicle engine and having a power input, and F. a master control unit attached to the outward side of said cover plate within the confines of said cover, and having electronic circuit means for receiving the output signals from said plurality of sensors add providing a spark coil signal that is applied to the power input of said spark coil, where said master control unit functions in combination with a microprocessor that operates with a firmware to control the operation of said system.

2. The system as specified in claim 1 wherein said engine control system is contained within a single structure.

3. The system as specified in claim 2 wherein said system is designed to be installed as original equipment to the intake manifold or the intake port of a reciprocating engine.

4. The system as specified in claim 2 wherein said system is designed as a retrofit unit that replaces a carburetor and is attached directly to the intake manifold or the intake port of a reciprocating engine.

5. The system as specified in claim 1 wherein said throttle body further comprises an additional plurality of fuel injection ports symmetrically located, in pairs, around the periphery of said throttle body, where into each said fuel injection port is attached a fuel injector that emits a fuel stream that impinges at the common point (F), located on the extended centerline of the throat of said throttle body where the turn-on of said fuel injectors is controlled by said master control unit.

6. The system as specified in claim 1 wherein said spark coil subsystem comprises:

a) a first spark coil attached to the vehicle engine and connected to a first spark coil output signal located on said master control unit, b) a second spark coil attached to the vehicle engine and connected to a second spark coil output signal located on said master control unit, where said first and second spark coils are arranged either:

(1) in parallel with a common connection to the first spark coil output signal on said master control unit, or (2) the first spark coil is connected to the first spark coil output signal on said master control unit and the second spark coil is connected to the second spark coil output signal on said master control unit, where this arrangement allows either a dual or single spark energy to be provided to the engine as dictated by said master control unit.

7. The system as specified in claim 1 wherein said master control unit further comprises electronic circuit means for maintaining a short history of throttle position data, where said data are applied to said master control unit to develop statistical parameters which are used by said master control unit to determine if the engine is current in the state of accelerating, cruising or decelerating or transitioning between said states, whereby said master control unit uses said parameters to alter fuel delivery and spark timing in a predetermined fashion to optimize engine performance in each of said states.

8. The system as specified in claim 1 wherein said master control unit further comprises electronic circuit means for determining which engine cylinder is receiving the air stream flowing through said throttle body and then metering the fuel from said fuel injectors into the air stream.

9. The system as specified in claim 8 wherein said master control unit further comprises electronic circuit means for controlling a fuel mixture or spark timing map that is automatically accessed by said master control unit at the closest map point corresponding to where the engine is currently operating, whereupon when an engine adjustment is made by a user entering a command via a control display unit, a serial port, or other means, the engine responds and said closest map point is automatically adjusted to a new value which corresponds to the user's command.

10. The system as specified in claim 1 further comprising a control display unit connected to said master control unit by means of an electrical cable, where said control display unit includes a plurality of system command switches, a digital display and an electronic circuit means for allowing the system parameters sensed by said sensors to be selected by said plurality of switches and viewed on the digital display and system control commands to be selected by said plurality of switches to allow adjustment commands to be sent to said master control unit.

11. The system as specified in claim 1 wherein said backing plate having a centered laminar air flow structure having a bore therethrough, an inward side and an outward side where the outward side of said throttle body is attached to the inward side of said backing plate over the bore.

12. The system as specified in claim 1 wherein said master control unit comprises at least the following system inputs and outputs:

a) a throttle position input, b) a throttle body temperature input, c) an engine position input, d) a first fuel injector power output that is applied to the power input of said first fuel injector, e) a second fuel injector power output that is applied to the power input of said second fuel injector, f) a fuel pump power output, g) a first spark coil output, h) a second spark coil output, i) a serial input/output port that allows an external input unit to be connected from where system parameters can be added, deleted of changed, j) a CDU control signal, and k) a power input that is connected to the vehicle battery via a circuit breaker.

13. The system as specified in claim 1 wherein said plurality of sensors comprise at least the following:

a) a throttle position sensor having an input and an output, where the input is connected to the shaft of the throttle plate, where said sensor senses the position of the throttle plate and where the output is connected to the throttle position input on said master control unit, b) a throttle body temperature sensor having an input and an output, where the input is connected to a side of said throttle body, where said sensor senses the temperature of said throttle body, and where the output is connected to the throttle body temperature input on said master control unit, and c) an engine position sensor having an input and an output, where the input is connected to the engine points, the camshaft or other rotating element, where the sensor senses the timing pulse of the engine, and where the output is connected to the engine position input on said master control unit.

14. The system as specified in claim 1 wherein said electronic circuit means for said master control unit further comprises:

a) an analog signal conditioner having electronic circuit means for receiving and conditioning the inputs from said sensor having analog outputs, b) a digital signal conditioner having electronic circuit means for receiving and conditioning the input signals from said sensors having digital outputs, c) a serial-input signal conditioner having electronic circuit means for receiving an external signal from said external input unit, d) said microprocessor further having electronic circuit means for:

(1) receiving and processing the conditioned signals from said analog signal conditioner, digital signal conditioner and serial input signal conditioners, (2) providing a signal that drives a plurality of internal power output drivers that control the operation of said:

(a) power relay, (b) first spark coil, (c) second spark coil, (d) first fuel injector, and (e) second fuel injector, (3) providing a signal that operates through an output port to drive a signal conditioner that produces a digital output signal, e) a CDU interface circuit having electronic circuit means for receiving internal input and output signals and having an output that is connected by means of said electrical cable to said control display unit, and f) a power input conditioner having circuit means for receiving the input power from said vehicle battery and producing a power signal that powers the electronic circuits of said master control unit.

15. An electronic engine control system that is operated by a sequential throttle body fuel injection subsystem comprising:

a) a throttle body having an inward side and an outward side, where the inward side is attached to the intake manifold of an engine and the outward side is attached to an inward side of a backing plate also having an outward side that is attached to an inward side of a cover plate further having an outward side, that via a plurality of standoffs, attaches to a cover, at least two cylinders, where said throttle body comprises a throat and a plurality of fuel injection ports symmetrically located around the periphery of said throttle body, with each fuel injection port having attached a fuel injector, and where each said fuel injector is angularly displaced inwardly, as measured from a frontal horizontal plane, into the throat of said throttle body, b) a plurality of fuel injectors attached to said fuel injection ports, where said fuel injectors do not intrude into the throttle body air stream and are angularly displaced to allow the fuel stream emitted from each said injector to impinge at a common point located on the extended centerline of the throat of said throttle body, c) means for sensing which engine cylinder is receiving the air stream passing through said throttle body, and d) a master control unit attached to the outward side of said cover plate within the confines of said cover, and having electronic circuit means for:

(1) processing the air stream data from said air stream sensing means, and (2) metering the fuel from the respective said fuel injector into the air stream in accordance with the requirements of said cylinder.

16. An electronic engine control system, comprising:

a) means for providing controllable injection of fuel into an engine, b) an ignition system capable of providing controllable ignition energy to an engine, c) an engine position sensor which measures an engine's rotational position and provides a signal indicating said rotational position, d) a throttle position sensor which measures a throttle's position and provides a signal indicating said throttle position, and e) a master control unit which determines the control signals required to control said controllable injection and said controllable ignition based on inputs from said throttle position sensor, said engine position sensor, and a time history of said throttle position sensor inputs kept and used by said master control unit to develop statistical parameters which said master control unit then uses to determine whether the engine is currently in the state of accelerating, cruising, or decelerating or transitioning between said states, whereby said master control unit uses said parameters to alter fuel and ignition control in a predetermined fashion such as to optimize engine performance in each of said states.

17. An engine control system that attaches to the engine intake manifold or intake port of a reciprocating engine and provides the engine with electronically controlled fuel-injection and a dual-ignition, said system comprising:

A. a sequential throttle body fuel injection subsystem comprising:

a) a backing plate having a centered laminar air flow structure having a bore therethrough, an inward side and an outward side, where the outward side is attached to an inward side of a cover plate further having an outward side that, via a plurality of stand-offs, attaches to a cover, where to the inward side of said backing plate is attached:

(1) a throttle body that is located over the bore on said backing plate and having a throat therethrough that further includes within the throat a throttle plate, a first fuel injection port that is angularly displaced inwardly into the throat, as measured from a horizontal plane, and a second fuel injection port that is also angularly displaced inwardly into the throat as measured from the horizontal plane, (2) a first fuel injector having an output port, an input port and a power input, where the output port is attached to the first fuel injection port on said throttle body, (3) a second fuel injector having an output port, an input port and a power input where the output port is attached to the second fuel injection port on said throttle body, where when said first and second fuel injectors are attached, they are angularly displaced to allow the fuel stream emitted from each said injector to impinge at a common point (F) located on an extended centerline of the throat of said throttle body, (4) a first fuel cap having a fuel injector attachment port, an input port and an output port where the fuel injector attachment port is attached to the input port on said first fuel injector, (5) a second fuel cap having a fuel injector attachment port, an input port and an output port, where the fuel injector attachment port is attached to the input port on said second fuel injector, (6) a high-pressure hose connected between the output port of said first fuel cap and the input port of said second fuel cap, B. at least one fuel pump having an input port, an output port and a power input, where the input port is connected to a fuel source by means of a low-pressure hose and the output port is connected by means of a high-pressure hose to the input port on said first fuel cap, C. at least one fuel pressure regulator having an input port connected by means of a high-pressure hose to the output port of said second fuel cap, and an output port connected by means of a low-pressure hose to the fuel sink return of the fuel source, D. an air filter having an inward side and an outward side, where said filter is removably placed over the laminar air flow structure with its inward side resting against the outward side of said backing plate, E. a master control unit attached to the outward side of said cover plate within the confines of said cover, and having electronic circuit means that functions in combination with a microprocessor that operates with a firmware to control the operation of said system, where said master control unit includes the following analog and digital system inputs and outputs:

a) a throttle position input, b) a throttle body temperature input, c) an engine position input, d) a first fuel injector power output that is applied to the power input of said first fuel injector, e) a second fuel injector power output that is applied to the power input of said second fuel injector, f) a fuel pump power output that energizes a power relay that allows power to be applied to the power input of said fuel pump, g) a first spark coil output, h) a second spark coil output, i) a serial input/output port that allows an external input unit to be connected from where system parameters can be added, deleted or changed, j) a CDU control signal, k) a power input that is supplied by a vehicle battery through a circuit breaker, F. a throttle position sensor having an input and an output, where the input is connected to the shaft of the throttle plate, where said sensor senses the position of the throttle plate and where the output is connected to the throttle position input on said master control unit, G. a throttle body temperature sensor having an input and an output, where the input is connected to a side of said throttle body, where said sensor senses the temperature of said throttle body, and where the output is connected to the throttle body temperature input on said master control unit, H. an engine position sensor that provides an engine position timing pulse signal that is applied to the engine position input on said master control unit, I. a first spark coil attached to the vehicle engine or chassis, J. a second spark coil attached to the vehicle engine or chassis, where said first and second spark coils are arranged either:

a) in parallel with a common connection to the first spark coil output on said master control unit, or b) the first spark coil is connected to the first spark coil output on said master control unit and the second spark coil is connected to the second spark coil output on said master control unit, where this arrangement allows either a dual or single spark energy to be provided to the engine as dictated by said master control unit, and K. a control display unit connected to the CDU control signal on said master control unit by means of an electrical cable, where said control display unit includes three system command switches: a first switch, a second switch and a third switch, an electronic display means and an electronic circuit means for allowing the system parameters sensed by said sensors to be selected by the three command switches and viewed on the electronic display means.

* * * * *